United States Patent [19]

Mulligan et al.

[11] 4,333,772

[45] Jun. 8, 1982

[54] TRAVELING PNEUMATIC CLEANER AND AUTOMATIC UNLOADING ARRANGEMENT AND METHOD

[75] Inventors: William L. Mulligan; Thomas R. House, both of Charlotte, N.C.

[73] Assignee: Parks-Cramer Company, Fitchburg, Mass.

[21] Appl. No.: 160,823

[22] Filed: Jun. 18, 1980

[51] Int. Cl.[3] ..... A47L 5/38

[52] U.S. Cl. ..... 134/18; 15/312 R; 134/21

[58] Field of Search ..... 15/312 R, 312 A, 301; 134/21, 18

[56] References Cited

U.S. PATENT DOCUMENTS

| | | | |
|---|---|---|---|
| 3,011,830 | 12/1961 | Holtzclaw | 15/312 A X |
| 3,011,925 | 12/1961 | Holtzclaw | 15/312 A X |
| 3,299,463 | 1/1967 | McEachern | 15/312 A |
| 3,372,425 | 3/1968 | Black | 15/312 A |

*Primary Examiner*—Chris K. Moore

*Attorney, Agent, or Firm*—Bell, Seltzer, Park & Gibson

[57] ABSTRACT

A plurality of traveling pneumatic cleaners for respective groups of textile machines cooperate with respective unloading stations for transferring fiber waste from collection chambers of the traveling cleaners into the unloading stations. All the unloading stations are connected, via normally closed valves, to a common source of suction, and according to the method and apparatus of this invention, provision is made for controlling the opening of the valves for the respective unloading stations so that only a single one of the valves may be opened at any given interval of time, thus minimizing the amount of suction required at the source for effectively transferring the fiber waste into the unloading stations. Further, a normally closed door for the collection chamber or chambers of each traveling cleaner is controlled so that the opening of each such door may be effected only at times when the valve of the respective unloading station is open.

20 Claims, 9 Drawing Figures

TRAVELING PNEUMATIC CLEANER AND AUTOMATIC UNLOADING ARRANGEMENT AND METHOD

FIELD AND BACKGROUND OF INVENTION

The disposal of textile fiber waste generated by textile machines has, for some time, been successfully accomplished by apparatus and method using traveling pneumatic cleaners. Such traveling pneumatic cleaners typically have blowing air outlets for directing flowing streams of air toward textile machines and suction air inlets for taking in air and fiber waste.

With many traveling pneumatic cleaners known to persons skilled in the textile and cleaning arts, fiber waste gathered by the cleaner is collected in a chamber. Such fiber waste collection chambers typically are formed as a portion of a traveling pneumatic cleaner and move with the cleaner along a predetermined path adjacent or extending over the textile machines.

It has been proposed heretofore that fiber waste collected in the chamber or chambers of a traveling pneumatic cleaner might be unloaded from the collection chamber periodically and automatically in response to movement of the cleaner. Such unloading arrangements typically provide doors on the collection chambers movable from normally closed position to opened position and an unloading station adjacent the path of travel of the traveling pneumatic cleaner and connected to an appropriate remote source of suction. In such unloading arrangements, the traveling cleaner and unloading station cooperate for unloading or withdrawing fiber waste from the collection chamber or chambers at periodic intervals so as to maintain high efficiency for the traveling pneumatic cleaner.

In fiber waste disposal systems installed in textile rooms containing a plurality of textile machines, economies can be realized by providing a central source of suction for the unloading stations, so as to draw fiber waste withdrawn from the traveling pneumatic cleaners to a single central location. Where a system includes a plurality of unloading stations, it is typically deemed appropriate to reduce the suction flow provided by the central station from the sum of the flows which would be required were each unloading station individually serviced. That is, if a room contains five unloading stations, it may be appropriate for a fiber waste disposal system to have a central suction source sized to accommodate three unloading stations. An assumption underlying such sizing is that no more than three of the unloading stations would be operative at any given time.

While experience with such fiber waste disposal systems has been successful, the energy required by a central suction source sized in accordance with the assumptions mentioned above is relatively great. Further, the assumption is not always correct, and an occasional activation of the design number (or more) of the unloading stations results in failure of the central collection system. That is, using the example above, in the event that four of the five unloading stations should be actuated simultaneously, none will efficiently unload the corresponding traveling cleaner or withdraw the fiber waste therefrom.

As will be appreciated, reduction in the sizing of components used in an unloading system will open the possibility of reduction in component cost. Further, where a traveling cleaner is unloaded each time that it passes adjacent an unloading station, significant wear and tear on components of the system occurs. Additionally, such frequent stopping for unloading reduces the number of cleaning passes of the textile machines, by occupying a portion of operating time with the unloading process.

BRIEF DESCRIPTION OF INVENTION

With the aforementioned discussion in mind, it is an object of the present invention to overcome deficiencies of prior automatic unloading fiber waste disposal systems. In realizing this object of the present invention, provision is made for timing the actuation of a fiber waste unloading station, so as to more efficiently use the fiber waste collection chamber or chambers on a traveling pneumatic cleaner. By permitting automatic unloading only at timed intervals, the expenditure of energy in moving a suction air flow is controlled.

Yet a further object of the present invention is to reduce the overall energy requirements for effecting removal of fiber waste from the collection chambers of a plurality of traveling pneumatic cleaners traveling adjacent respective groups of textile machines, and wherein respective unloading stations for the traveling cleaners are connected to a common source of suction to aid in removal of fiber waste from the chambers. In realizing this object of the invention, each unloading station is provided with control means, and the control means of at least a plurality of the unloading stations are interconnected. By such interconnection, only a single one of the unloading stations of the plurality may be actuated at any given time. Thus, many system components may be of smaller capacity to provide suction air flow for only a single unloading station so as to provide economies in both initial expenditures and ongoing energy requirements.

In accordance with a preferred embodiment of the invention, fiber waste collected in the collection chambers of traveling pneumatic cleaners traveling in predetermined paths adjacent respective groups of textile machines is transferred from the collection chamber or chambers of each traveling cleaner into a respective unloading station. All the unloading stations are connected to a common source of suction, and normally closed valve means controls the flow of suction air into each respective unloading station. Individual control units are operably associated with each unloading station for effecting opening of the respective valve means and also for effecting opening of normally closed door means for the collection chamber or chambers of the respective traveling cleaner in response to and upon only certain occasions of movement of the respective traveling cleaner into proximity to the respective unloading station. The control units of all the unloading stations are interconnected so that, while any one of the control units is operating in effecting opening of the valve means of a respective unloading station and opening of the door means of a respective traveling cleaner, the then operating control unit renders all the other control units inoperative so that the valve means of only a single one of the unloading stations may be opened at any given instant.

Some of the objects and advantages of the invention having been stated, others will appear as the description proceeds when taken in connection with the accompanying drawings, in which FIG. 1 is a schematic plan view of groups of textile machines in a textile room illustrating an arrangement of a plurality of traveling pneumatic cleaners and corresponding unloading stations for disposal of fiber waste generated by the textile machines;

DETAILED DESCRIPTION

While this invention will be described hereinafter with particular reference to the accompanying drawings, in which an illustrative embodiment of the present invention is set forth, it is to be understood at the outset of the description which follows that it is contemplated that persons skilled in the applicable arts may modify the specific details to be described while continuing to use this invention. Accordingly, the description is to be understood as a broad teaching of this invention, directed to persons skilled in the applicable arts.

Figure 1:
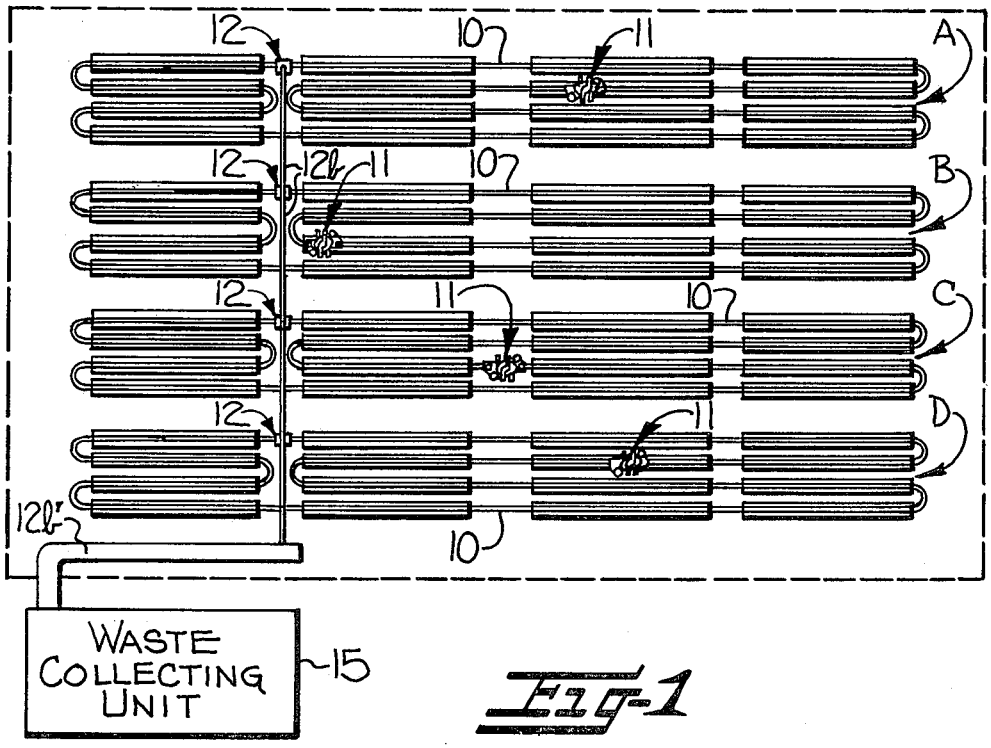

Referring more specifically to the drawings, there will be observed in FIG. 1 a plurality of groups of fiber waste generating textile machines, such as looms, spinning frames, twisters and the like. Typically, the textile machines are arranged in spaced parallel rows, there being four longitudinal rows of machines in each group, for example, and there being four groups A, B, C, D, of the machines illustrated in FIG. 1. An endless track 10 extends adjacent or over the machine rows in each group A-D, and a respective traveling pneumatic cleaner 11 is movable along the track 10 for each textile machine group A-D. Thus a traveling pneumatic cleaner 11 is movable along a predetermined path defined by a respective track 10 adjacent each respective group A-D of textile machines.

The tracks 10 may be endless, as shown, or they may be double-ended, since traveling pneumatic cleaners currently in use in the textile industry generally are equipped with reversing means for reversing the direction of travel of the cleaner at opposite ends of its traverse along a double-ended track and/or at any point in its travel upon the traveling cleaner engaging an obstruction in its path, as is well known.

In any event, since the traveling pneumatic cleaners 11 are movable along respective individual tracks, desirably an individual unloading station means 12, referred to hereinafter as an "unloading station," is provided adjacent each track 10 for receiving and disposing of fiber waste from at least one fiber waste collection chamber on a respective traveling cleaner 11, which fiber waste is collected in the collection chambers as it is being picked up by suction from the floor and/or machine surfaces incidental to the travel of each traveling cleaner along the respective group of machines. For the sake of economy in manufacture and maintenance, as well as economy and efficiency in the use of energy, all the unloading stations 12 are connected to a common source of suction at a central collection area or waste collection unit 15, and according to the method and apparatus of the present invention, control means or control units A'-D' (FIG. 9) are associated with the unloading stations 12 of the respective machine groups A-D for operating respective valve means at certain times upon movement of the respective traveling cleaners into proximity to their respective unloading stations 12 and also for opening the normally closed collection chamber door means of the respective traveling cleaners for transferring fiber waste from the collection chambers of the respective traveling cleaners into the respective unloading stations 12.

Also, the control units A'-D' are interconnected as will be later described, so that during the transfer of fiber waste from any one of the traveling pneumatic cleaners 11 into a respective unloading station 12, the respective then active control unit renders inoperative those control units associated with all the other unloading stations 12. Thus, it can be appreciated that the capacity of the suction source at the waste collection unit 15 may be relatively small, since the valve means of only one of the unloading stations 12 would be opened to the flow of air therethrough to the suction source at any given instant.

In the description which follows, only that traveling pneumatic cleaner 11, that unloading station 12 and that control unit A' associated with the machine group A will be described in detail, it being understood that all the traveling pneumatic cleaners 11 in FIG. 1 may be of essentially the same construction, and all of the unloading stations 12 of FIG. 1 may be of essentially the same construction.

Referring now to FIGS. 2-5 and 7, the traveling pneumatic cleaner 11 there shown is generally of the type disclosed in U.S. Pat. No. 3,372,425, issued Mar. 12, 1968, and owned in common with the present invention. The disclosure in said patent is incorporated herein by reference to the extent necessary to clearly understand the present invention.

The traveling pneumatic cleaner 11 comprises housing means 20 supported on a motor-driven, wheeled carriage 23 (FIG. 3) mounted for movement on the respective track 11. The housing means 20 may include dependent flexible blowing tubes 21 and flexible suction tubes 22 whose upper portions communicate with respective blowing and suction sections of housing means 20, and which sections contain suitable air impeller means, not shown. For the purpose of this description, the left-hand end of the traveling cleaner 11 as viewed in FIGS. 2 and 3 will be considered as the forward or front end of the traveling cleaner, although the traveling cleaner may travel along the corresponding track 11 in either direction. Accordingly, it will be observed in these FIGS. 2 and 3 that the housing means is provided with front and rear fiber waste collection chambers or canisters 26, 26' which communicate with the exhaust portion or section of the housing means 20 for receiving therein fiber waste drawn into the housing means 20 by suction air streams flowing thereinto through the dependent suction tubes 22, all of which is fully disclosed in said U.S. Pat. No. 3,372,425. Although the traveling pneumatic cleaner 20 is equipped with two collection chambers 26, 26', it may be equipped with a single collection chamber or more than two collection chambers, it being noted that the traveling pneumatic cleaner of said patent is provided with four collection chambers, for example.

Figure 5:
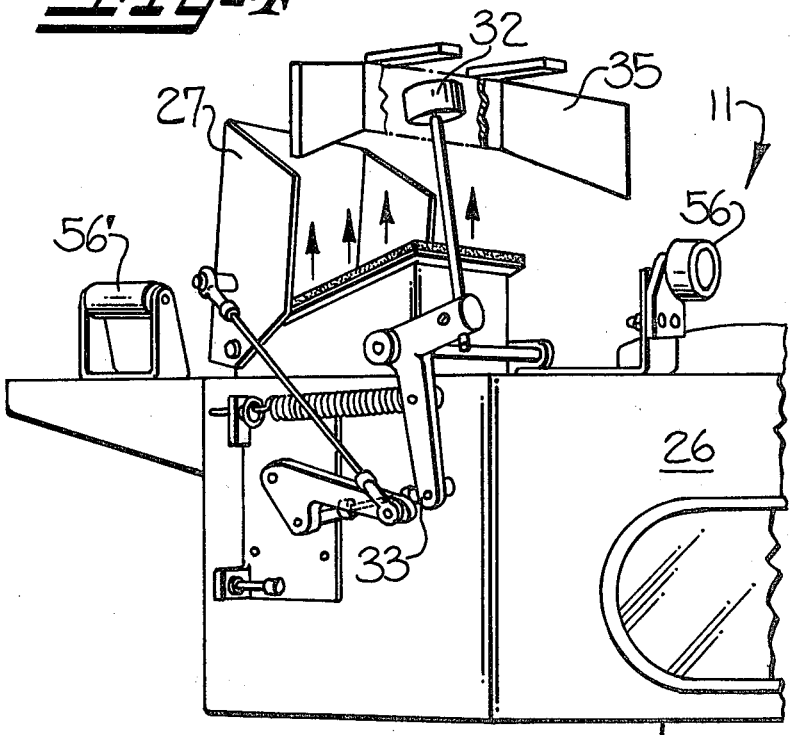
FIG. 5 is an enlarged fragmentary view of the central portion of FIG. 4, but looking at the left-hand side of the traveling cleaner in FIG. 3 to show the door means in opened position.
Figures 6, 7, 8:
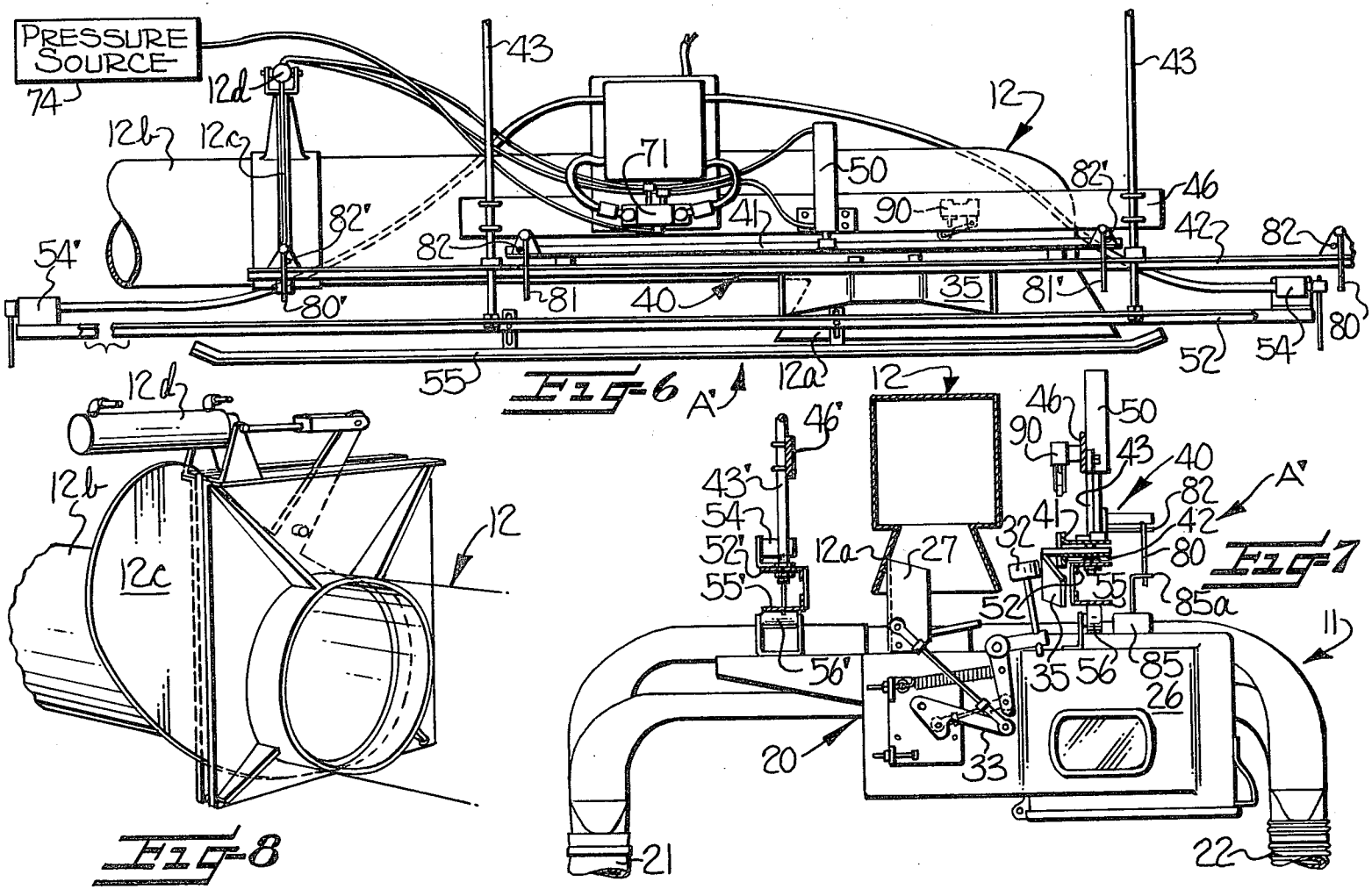
FIG. 6 is an enlarged detailed elevational view of the unloading station of FIG. 3 and associated control means for effecting the transfer of fiber waste from the respective traveling pneumatic cleaner collection chambers into the unloading station.
FIG. 7 is another view looking at the left-hand side of FIG. 3 and also being taken looking substantially along line 7—7 in that figure to better illustrate some of the details of the unloading station, and wherein cam means for opening the normally closed door means on the collection chambers of the traveling cleaner is shown in active position.
FIG. 8 is an enlarged fragmentary perspective view of a normally closed valve means or gate valve for controlling the flow of suction air into the unloading station.

The collection chambers 26, 26' are provided with respective normally closed discharge door means 27, 27' located adjacent the respective front and rear ends of housing means 20, and which are shown in the form of hinged or pivoted doors or covers in FIGS. 2–5 and 7. Each door means 26, 26' is adapted to be tilted upwardly from the normally closed position (FIG. 4) to the opened position (FIGS. 3, 5 and 7) adjacent an opened downwardly facing mouth **12*a* of the respective unloading station 12 at times in the course of certain movements of the traveling pneumatic cleaner adjacent the unloading station 12, as will be more fully described later herein. Therefore, actuating followers 32, 32' project upwardly from the respective collection chambers 26, 26' and are connected, by suitable respective linkages 33, 33' carried by the collection chambers 26, 26' to the respective door means 27, 27'. A cam means 35 is located adjacent the mouth 12*a* of the unloading station 12 (FIGS. 3 and 5–7) and normally occupies an inactive position (FIGS. 6 and 9) out of the path of travel of the followers 32, 32' on the respective traveling pneumatic cleaner 11. However, when the cam means 35 is moved into an active position, as shown in FIGS. 5 and 7, by means to be later described, the followers 32, 32' successively engage cam means 35 which is so shaped as to displace the followers 32, 32' from their normally substantially upright positions and thereby swing the respective door means 27, 27' to the opened position, as shown in the left-hand portion of FIGS. 2 and 3 and in FIGS. 5 and 7**.

Referring now to FIGS. 3, 6, 8 and 9, it will be observed that the unloading station 12 there shown is in the form of an elongate duct **12*b* having the mouth 12*a* thereon and having its other end communicatively connected, via a common duct means 12*b'* (FIG. 1) to the waste collecting unit 15. The duct 12*b* of each unloading station 12 has a suitable normally closed valve means 12*c* interposed therein (FIGS. 3, 6, 8 and 9), which is shown in the form of a gate valve movable between its normally closed position (FIG. 9) and a fully opened position (FIG. 8) by suitable motive means, embodied in a fluid cylinder or ram 12*d*, for controlling the flow of suction air into the unloading station 12**.

Figure 9:
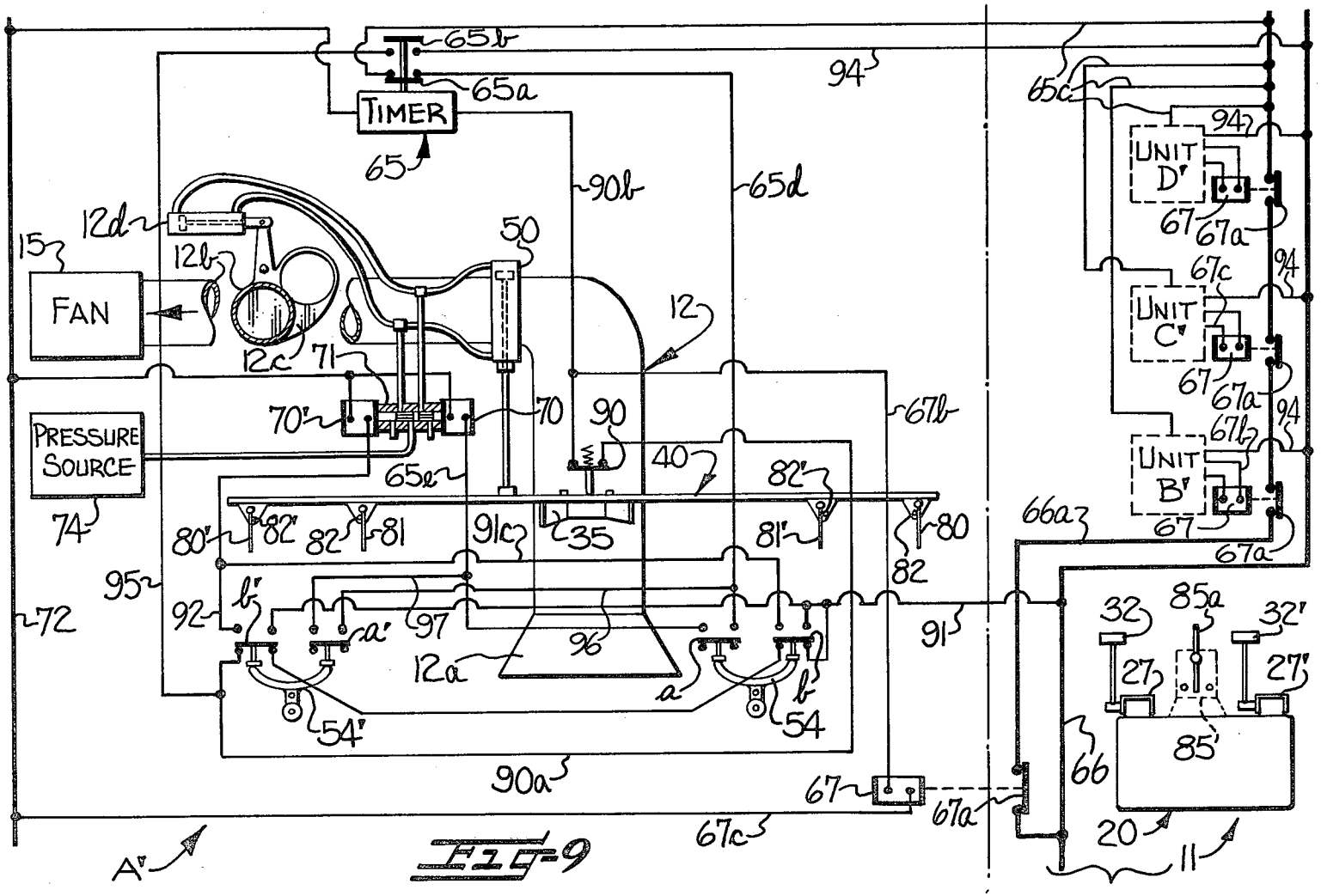
FIG. 9 is a schematic diagram of a preferred embodiment of electrical circuit means associated with the control means for each unloading station.

It is apparent, by referring to FIGS. 6 and 9, that the ram **12*d* is a part of the control means A' for effecting opening of the valve means 12*c* of the unloading station 12 and the door means 27, 27' of the respective traveling cleaner 11 upon only certain occasions of movement of the traveling cleaner into proximity to the respective unloading station 12. Accordingly, the control means A' further comprises carrier means, broadly designated at 40, adjacent the unloading station 12 and being movable or transformable from a normally inactive condition to an active condition relative to the traveling cleaner 11. The carrier means 40 is embodied in a pair of elongate substantially horizontally disposed, forwardly and rearwardly extending frame members or bars 41, 42 (FIGS. 6 and 7) extending along one side of the unloading station 12 and being movable from a normally inactive or raised position to an active or lowered position relative to the path of the traveling cleaner 11 along the corresponding track 10. Thus, it can be seen that the transformation of the instant embodiment of the carrier means 40 is effected by substantially vertical movement thereof between the inactive and active positions shown in FIGS. 6 and 7**, respectively.

Figure 3:
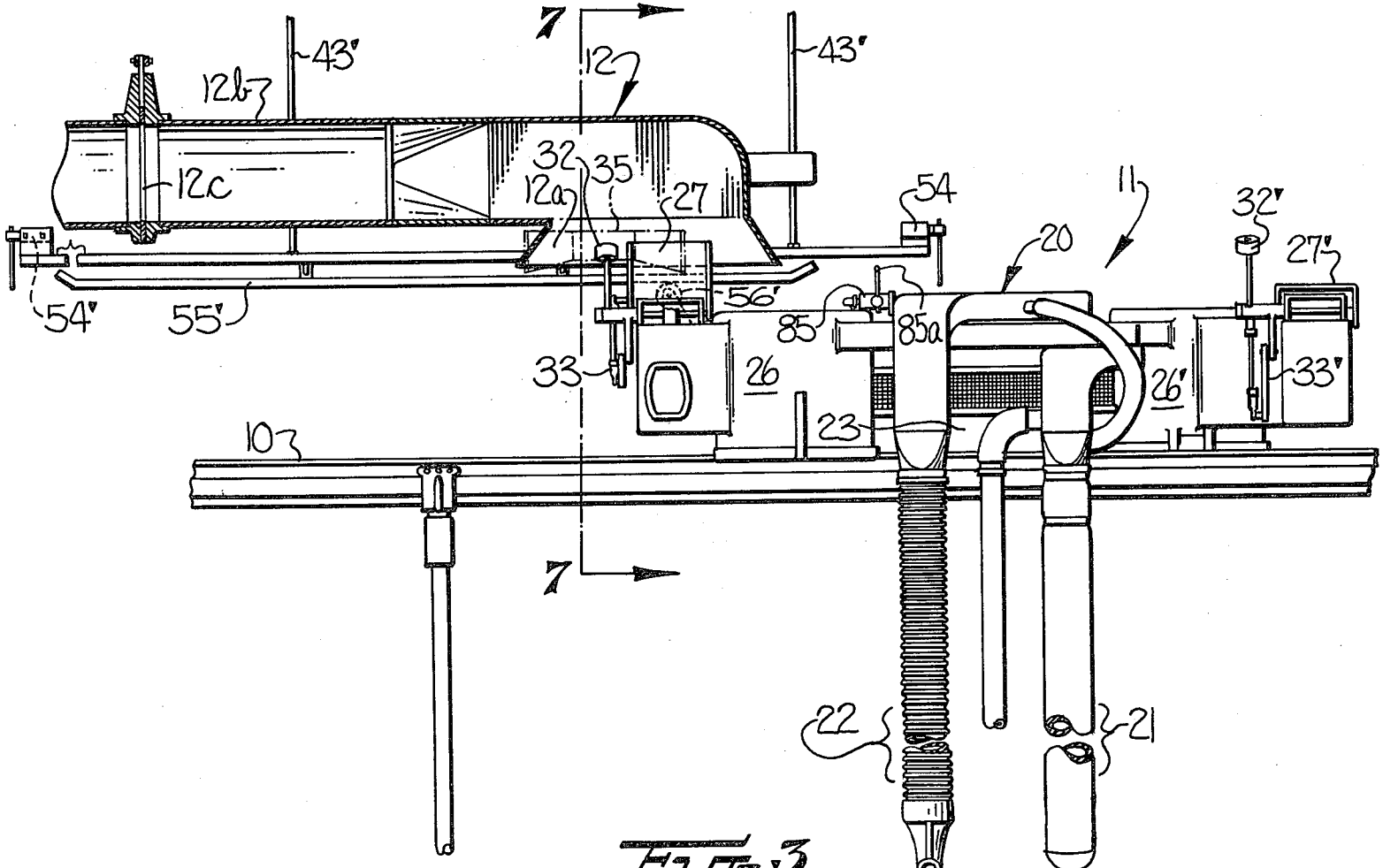
FIG. 3 is an enlarged side elevational view looking upward from the bottom of FIG. 2 and showing the door means of one of the collection chambers of the traveling cleaner in opened unloading position with respect to the respective unloading station shown in longitudinal section.
Figure 4:
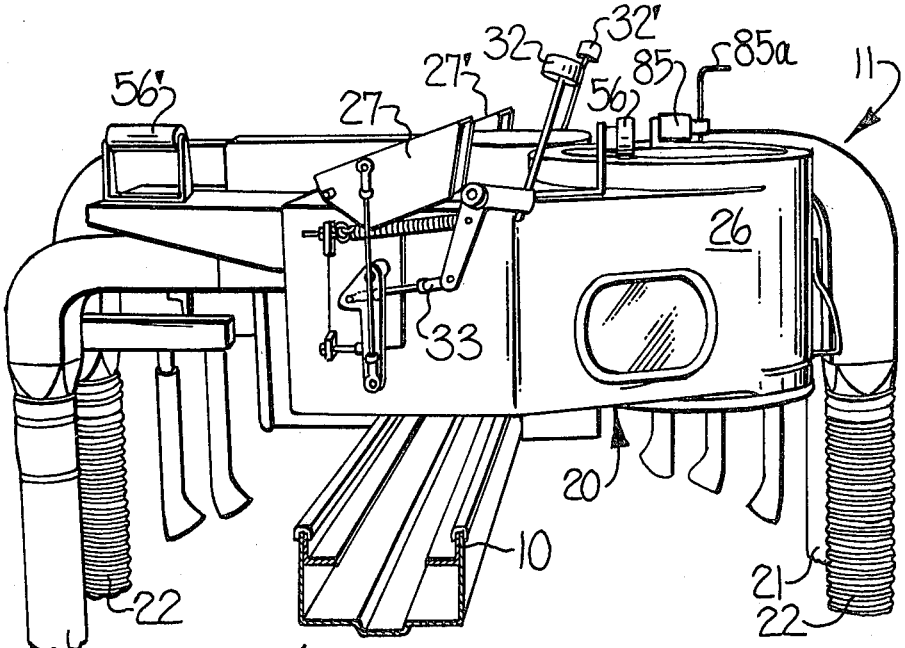
FIG. 4 is a perspective view looking at the left-hand end of the traveling cleaner as viewed in FIGS. 2 and 3, but wherein the door means of both collection chambers are closed.

As shown in FIG. 6, the upper frame member 41 or carrier means 40 may be substantially shorter than the lower frame member 42, to which the opposite end portions of the upper frame member 41 are suitably secured. The lower frame member 42 of carrier means 40 may be guided for substantially vertical sliding movement on a pair of upright guide rods or posts 43 which may be suitably suspended from the ceiling of the textile room. A stabilizing frame member 46 extends between and is suitably secured to the lower portions of the guide rods 43 above the level of the frame member 41 of carrier means 40, and the frame member 46 also serves as a support for various components of the electrical circuit of the control unit A' shown in FIG. 9, and to be later described. A similar stabilizing frame member 46' is mounted on suspended posts or rods 43' adjacent the other side of unloading station 12 (FIGS. 3 and 7). The stationary component or cylinder of a fluid operated ram 50 is suitably secured to the stabilizing frame member 46 and has the lower end of the movable component thereof suitably attached to the medial portion of the upper frame member 41 of carrier means 40. The cam means 35, for opening the normally closed door means 27, 27' of the traveling cleaner 11, is suitably secured to the lower frame member 42 of the carrier means 40 and is thus movable with the carrier means 40 between the normally inactive position and the active position thereof.

The lower ends of the guide rods 43, 43' below the level of the carrier means 40, support respective elongate substantially horizontal disposed bars or frame members 52, 52'. The rear and forward portions of frame member 52' have respective sensors or composite sensing switches 54, 54' (FIGS. 3, 6, 7 and 9) mounted thereon and positioned along opposite sides of the unloading station 12 in such a manner as to be tripped by the traveling pneumatic cleaner 11 as it moves past the control unit A' and the respective unloading station 12. Suitable elongate stabilizing track means 55, 55' extend beneath and substantially parallel to the respective frame members 52, 52' and may be adjustably secured to the frame members 52, 52' so as to be engaged by respective rollers 56, 56' (FIGS. 2, 3, 4, 5 and 7) mounted on the traveling cleaner to aid in stabilizing the traveling cleaner as it is moving past the control unit A' and the respective unloading station 12. As shown, the traveling cleaner 11 includes two spaced rollers 56 and one roller 56'. The roller 56' is located adjacent the forward end of the housing 20 of the traveling cleaner 11, as best shown in FIGS. 2–5.

The movable actuators of the sensing switches 54, 54' extend below the level of track means 55' so as to be successively engaged and swung forwardly momentarily by the roller 56' on the traveling cleaner 11 as it moves forwardly in FIG. 3. Of course, as the traveling cleaner 11 moves rearwardly, from left to right, in FIG. 3, the roller 56' thereon successively engages and swings the movable actuators of sensing switches 54, 54' rearwardly momentarily. Thus, the switches 54, 54' serve as respective means for, at times, sensing movement of the traveling cleaner 11 into proximity to the unloading station for purposes to be presently described.

Referring now to FIG. 9, it will be observed that the control means or control unit A' further comprises timer means 65 of a well-known type having a normally operating time cycle of predetermined duration, the timer means 65 being operable to prevent transformation or movement of the carrier means 40 from its normally inactive position to the aforementioned active position relative to the traveling cleaner 11 during each such operating time cycle. In practice, a timing means was used having an adjustable normally operating time cycle of about 0 to 60 minutes adjusted to about ten minutes.

During each normally operating time cycle of timer means 65, switches 54, 54' are inactive and thus cannot initiate a cycle in the operation of control unit A'. However, whenever the timer means 65 has "timed out" contactors **65*a*, 65*b* thereof occupy the respective closed and opened positions in which they are shown in FIG. 9, preparatory to an unloading cycle in the operation of control unit A' being initiated in response to the traveling cleaner 11 the next time the traveling cleaner moves into proximity to the unloading station 12, regardless of whether the traveling cleaner 11 is approaching the unloading station 12 as it is moving from left to right in FIG. 3 or from right to left in FIG. 3. In other words, means are provided which are responsive only to those movements of the traveling cleaner into proximity to the unloading station 12 which occur at intervals between successive time cycles of the timer means 65 for opening the valve means 12*d* and for moving the carrier means 40** into the active position.

To this end, assuming that the traveling cleaner 11 is moving forwardly or from right to left in FIGS. 3 and 9 and toward the observer in FIG. 7, the roller 56' on the then leading portion of the traveling cleaner 11 moves into engagement with and actuates the rear sensing switch 54 by closing a normally opened contactor a (FIG. 9). Thus, current normally will flow from a lead conductor 66 through the normally closed contactor **67*a* of a relay 67, through conductors 66*a*, 65*c*, the contactor 65*a* of timer means 65, a conductor 65*d*, the contactor a, a conductor 65*e*, and through a coil 70 of an electrically operated control valve means 71, to another lead conductor 72**.

Figure 2:
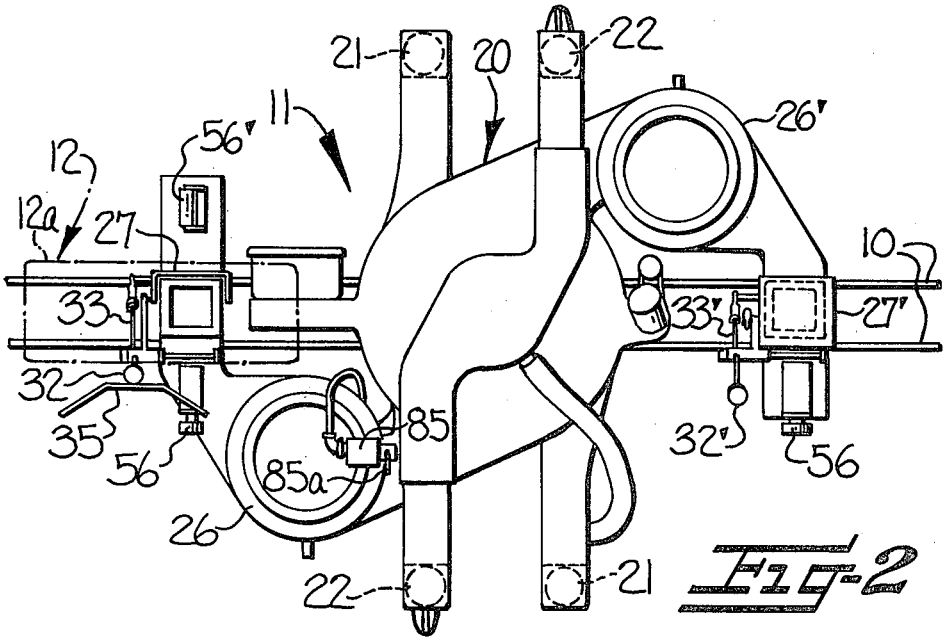
FIG. 2 is an enlarged top plan view of one of the traveling pneumatic cleaners of FIG. 1 with the door means on one of the collection chambers of the traveling cleaner occupying open position and the door means on another of the collection chambers occupying closed position.

The consequent energization of the coil 70 of control valve means 71 then permits pressurized fluid to flow from a suitable source 74 (FIG. 9) through control valve means 71 to the upper end of the cylinder of ram 50 in FIGS. 6, 7 and 9 to thereby move the carrier means 40 and the cam means 35 thereon from their normally inactive or raised positions of FIGS. 6 and 9 to the lowered or active position in which the cam means 35 is shown in FIGS. 2, 5 and 7. Opposite end portions of the lower elongate frame member 42 of carrier means 40 (FIGS. 6, 7 and 9) have suitable pivoted "one-way" switch actuating elements or trippers 80, 80' thereon between which a longitudinally spaced similar pair of trippers 81, 81' are positioned. The latter trippers 81, 81' are shown suitably supported on the upper bar 41 of carrier means 40. It is to be noted that the trippers 80, 81 are pivotally suspended from carrier means 40 and are restrained from being pivoted in a forward direction or from right to left in FIGS. 6 and 9 by suitable stationary abutments 82. The trippers 80', 81' also are pivotally suspended from carrier means 40, but contrary to the trippers 80, 81, the trippers 80', 81' are restrained from being moved in a rearward direction or from left to right in FIGS. 6 and 9 by respective stationary abutments 82'. When the carrier means 40 occupies the active, lowered, position, the trippers 80, 81, 80', 81' are then positioned in the path of travel of the movable actuator **85*a* of a suitable time delay motor control switch 85 (FIGS. 2, 3, 4, 7 and 9) operably connected to the drive motor (not shown) for the wheeled carriage 23 (FIG. 3) of the traveling pneumatic cleaner 11. As best shown in FIG. 7, the switch 85 is suitably mounted on the housing means 20 of the traveling pneumatic cleaner 11**.

The time delay switch 85 serves to stop or interrupt the flow of current to the drive motor for the wheeled carriage 23 of the traveling cleaner 11 for a predetermined relatively short period of time each time the actuator **85*a* of the switch 85 engages any one of the trippers 80, 80', 81, 81' which is then restrained from being moved in the direction of movement of the traveling cleaner 11. In other words, the actuator 85*a* will be moved relative to the traveling cleaner 11, to initiate a time delay cycle of the switch 85 whenever the actuator 85*a* is moved into engagement with the trippers 80, 81 in succession. However, while moving in the same direction (from right to left in FIG. 9) the trippers 80', 81' will not then actuate the delay mechanism of the switch 85, but will simply swing from right to left about their respective pivots as the traveling cleaner moves past the same in a forward or right to left direction in FIGS. 6 and 9. On the other hand, upon rearward movement of the traveling cleaner 11 past the carrier means 40, it is apparent that the trippers 80', 81' will be successively engaged by and will effect actuation of the switch actuator 85*a* because of the trippers 80', 81' being restrained from swinging movement from left to right in FIG. 9 by the respective abutments 82'. As the traveling cleaner moves from left to right past the carrier means 40 in FIGS. 6 and 9, it is apparent that the actuator 85*a* of switch 85 will simply successively move the trippers 81 and 80 rearwardly or from left to right in FIGS. 6 and 9 as the actuator 85*a* moves past the same. The time delay control switch 85 and the trippers 80, 80', 81, 81' are provided so as to permit the traveling cleaner to pause or slow down in its travel in either direction past the carrier means 40 while the fiber waste is being transferred from each successive collection chamber of the traveling cleaner into the mouth 12*a* of the respective unloading station 12**.

In this regard, it is apparent that, while the carrier means 40 occupies the active or lowered position, upon forward movement of the traveling cleaner 11 from right to left in FIGS. 2 and 3, the cam means 35 will be successively engaged by the respective followers 32, 32' to thus open the respectively normally closed door means 27, 27' for the respective collection chambers 26, 26' as they successively move into registration or substantial alignment with the mouth 12*a* of the respective unloading station 12 for transferring fiber waste from the respective collection chambers of the traveling pneumatic cleaner into the unloading station.

It is also apparent that the normally closed door means 27', 27 on the traveling cleaner 11 will be opened in succession during movement of the traveling cleaner in a rearward direction or from left to right in FIGS. 2 and 3 past the carrier means 40 and the cam means 35 thereon for successively transferring fiber waste from the respective collection chambers 26', 26 of the traveling pneumatic cleaner 11 into the unloading station 12, in the event of the carrier means 40 then occupying its active or lowered position heretofore described.

In order to reset the timer means 65 following the transferring of fiber waste from the successive collection chambers 26, 26' of the traveling cleaner 11 into the unloading station 12 corresponding to the control unit A', and to also avoid opening the valve means 12*c* of any of the unloading stations 12 controlled by the respective control units B', C', D' while that valve means 12*c* being controlled by the control unit A' occupies opened position, a reset switch 90, normally held in closed position by the vertically movable carrier means 40 and mounted on the frame member 46 (FIGS. 6 and 7), is permitted to open as the carrier means 40 moves away from the switch 90 to its active position. Since the reset switch 90 is interposed in the electrical circuit between the lead conductors 66, 72 and in series with the timer means 65, it follows that the opening of the reset switch 90 interrupts the flow of current to the timer means 65, to thus reset the timer means 65. It will be observed in FIG. 9 that the reset switch 90 is also interposed in the electrical circuit to the coil of the relay 67 so that the coil of the relay 67 is de-energized whenever the carrier means 40 moves from its normally inactive to its active position.

It will be observed in the right-hand portion of FIG. 9 that each of the control units A', B', C', D' is provided with a respective one of the relays 67 therein, and the contactors 67*a* of all the relays 67 are arranged in series in the common electrical conductor 66*a* so that all of the contactors 67*a* of the relays 67 must be closed in order for current to flow through that contactor 65*a* of any one of the control units A'-D'. In this regard, each of the control units A'-D' is provided with a respective conductor 65*c* which, as shown in the uppermost portion of FIG. 9, leads from one side of the respective contactor 65*a* of timer means 65 to the conductor 66*a*, and all the conductors 65*c* are connected to the conductor 66*a* beyond all of the contactors 67*a* with respect to the point at which the conductor 66*a* is connected to the lead conductor 66. It follows, therefore, that in the event the timer means of any one of the control units A'-D' completes its normally operating time cycle at an instant during which the carrier means 40 of any one of the other control units already occupies an active position, that control unit whose timing means 65 has just completed a normal operating time cycle will not function to initiate an unloading cycle at the unloading station at least until after a cycle in the operation of the then operating control unit will have been completed.

Thus, it can be seen that the control units A'-D' reduce the frequency of transference of fiber waste from the collection chambers 26, 26' of each respective traveling cleaner 11 into a respective unloading station 12 permitting an effective reduction in energy requirements. Also, such reduction in energy requirements is further enhanced by the fact that fiber waste is transferred from the collection chamber or chambers of only one of the traveling cleaners at a time.

It will be noted that, following a forward movement of the traveling cleaner 11 during which both of the door means 27, 27' of the respective collection chambers 26, 26' have been opened and fiber waste transferred therefrom into the unloading station 12, the roller 56' on the traveling cleaner 11 then moves forwardly out of engagement with the respective track means 55' (FIG. 3) and into engagement with the sensing switch 54' (FIGS. 3 and 9). In so doing, the roller 56' (FIGS. 2, 3, 4 and 5) momentarily engages and moves the actuating arm of the switch 54' so as to move the contactor b' thereof from the lowered position shown in FIG. 9 to the raised position in which it establishes flow of current from lead conductor 66, and between conductors 91, 92, thus energizing the coil 70' of valve means 71 to reverse the position of the core of the valve means 71 and thus cause the introduction of fluid into the lower end of the cylinder of ram 50 and into the right-hand end of the cylinder of ram 12*d* in FIG. 9, thus returning the carrier means 40 to its inactive position and closing the valve means 12*c* of the respective unloading station 12.

As the carrier means 40 returns to its normally inactive position, it is apparent that it enagages and closes the reset switch 90. Since the traveling cleaner will then have moved forwardly beyond the sensing switch 54', it is apparent that the contactor b' thereof will have returned to its lower position of FIG. 9, and current then will flow from the lead conductor 66, through conductor 91, through the contactors b, b' of the respective sensing switches 54, 54', through the conductor 90*a*, through the reset switch 90, through the conductor 90*b* and timer means 65 and thus to the lead conductor 72 to initiate a succeeding normal operating time cycle of timer means 65 during which the contactor 65*a* is moved to open position and the contactor 65*b* is moved to closed position. Also, upon the carrier means 40 closing the reset switch 90, since current is then flowing through the conductor 90*b*, it is apparent that current will also flow through the conductor 67*b*, the coil of relay 67 and the conductor 67*c* to the lead conductor 72 to energize the coil of relay 67 and thus move the corresponding contactor 67*a* to the closed position preparatory to a repeat cycle of the control unit A' or any one of the other control units B', C', D' in the manner heretofore described with respect to the control unit A'. The timer contactor 65*b* serves to insure that current flow through timer means 65 may not be interrupted by displacement of contactors b, b' (which occurs during each successive movement of the traveling cleaner 11 past the respective unloading station 12 and its control unit) during a normally operating time cycle of the timer means 65. Thus, when contactor 65*b* and reset switch 90 are both closed, current will flow from lead conductor 66 through a conductor 94, contactor 65*b*, conductors 95, 90*a*, 90*b* and reset switch 90, through the timer means 65, and also through the coil of the respective relay 67.

It is to be noted that the contactors a', b of the respective sensing switches 54', 54 (FIGS. 3, 6 and 9) function in succession during rearward or left to right movement of the traveling cleaner 11 past the unloading station 12 in FIG. 9 in essentially the same manner as that in which the contactors a, b' function during forward or right to left movement of the traveling cleaner 11. More specifically, when roller 56' engages and momentarily swings the movable actuator of switch 54' rearwardly, it momentarily closes the starter contactor a'. If the timer means 65 then is in "timed out" condition, with contactor 65*a* closed, contactor 65*b* opened and the contactors 67*a* of all the relays 67 closed, the starter contactor a' will energize coil 70 of valve means 71 as current flows through lead conductor 66, branch conductor 66*a*, relay contactors 67*a*, conductor 65*c*, timing contactor 65*a*, conductors 65*d*, 96, starter contactor a', conductors 97, 65*e*, and coil 70 to the lead conductor 72. Thus, the carrier means 40 is again moved downwardly from its normally inactive position to its active position in the manner substantially as heretofore described.

Thereupon, the trippers 80', 81' and cam means 35 function in the manner heretofore described to successively reduce the speed of or stop movement of the traveling cleaner 11 from left to right in FIGS. 2 and 3 for relatively short periods as the normally closed door means 27', 27 of the collection chambers 26', 26 of the traveling cleaner 11 are successively opened for transferring the fiber waste from the successive collection chambers 26', 26 into the respective unloading station 12, whose valve means 12*c* then occupies opened position.

Following the transfer of fiber waste from the successive collection chambers 26', 26, roller 56' then engages and momentarily swings the movable actuator of switch 54 rearwardly to energize the coil 70' of valve means 71 as current flows through lead conductor 66, conductor 91, contactor b of sensing switch 54, through conductors 91*c*, 92 and coil 70' of valve means 71 to the lead conductor 72. The valve means 12*c* then returns to its closed position as carrier means 40 is returned to its normally inactive or raised position in the manner heretofore described, thus closing reset switch 90 to initiate another time cycle in the operation of the timer means 65 as the respective relay 67 is again energized to close the respective contactor 67*a*, and as the contactor 65*a* of timer means 65 is moved to opened position and the contactor 65*b* is returned to closed position to prevent the starting of another cycle in the operation of the control unit A' of FIG. 9 until the corresponding timer means 65 has again completed a normal operating time cycle thereof and the roller 56' on the respective traveling cleaner 11 has again engaged and imparted movement to the movable actuator of one or the other of the sensing switches 54, 54' while all of the relay contactors 67*a* occupy closed position.

From the foregoing description, it is believed that the operation of each of the control units A'-D' associated with the respective groups A-D (FIG. 1) of textile machines may be clearly understood and, accordingly, a further description thereof is deemed unnecessary.

It is thus seen that the present invention provides an improved method and apparatus for disposing of fiber waste in a textile room containing fiber waste generating textile machines arranged in groups A-D, and wherein a traveling cleaner 11 having at least one fiber waste collecting chamber 26 and/or 26' thereon is provided which travels in a predetermined path adjacent each respective group of the textile machines, the fiber waste collection chamber normally being closed by door means and being movable with the traveling cleaner adjacent a respective unloading station 12. It can be appreciated that all the unloading stations 12 are connected to a common source of suction embodied in the waste collection unit 15 (FIG. 1), and each unloading station 12 has an associated normally closed valve means 12*c* for controlling the flow of suction air into the respective unloading station.

It can also be seen that the valve means 12*c* of each unloading station 12 and the door means 27, 27' of the respective collection chambers 26, 26' of the respective traveling cleaner 11 are opened in response to movement of the respective traveling cleaner 11 into proximity to the respective unloading stations 12 for transferring fiber waste from the collection chambers into the respective unloading station. It can be seen also that the valve means 12*c* of all the unloading stations 12 and the door means of all of the respective traveling cleaner collection chambers are closed for respective repeated predetermined timed cycles established by the respective timing means 65 (FIG. 9), which time cycles include at least some occasions of repeated movement of each respective traveling cleaner past its respective unloading station 12 and so that the opening of each valve means 12*c* and the opening of the door means 27, 27' of the collection chamber or chambers 26, 26' of each respective traveling cleaner 11 may occur only during intervals between successive time cycles determined by the corresponding timer means 65.

Stated otherwise, it is to be noted that each traveling cleaner 11 is repeatedly moved past the respective unloading station 12 during its travel along a predetermined path associated with a respective group of the textile machines, and it is only during certain movements of the traveling cleaner past the unloading station that transfer of fiber waste is effected from the respective collection chamber or chambers 26, 26' into the respective unloading station by suction. Thus, there is a reduced frequency of transference of the fiber waste from the collection chamber or chambers of each traveling cleaner which permits an effective reduction in suction energy requirements.

It also can be seen that, upon the occurrence of the opening of any one of the valve means 12*c* and the door means associated with a respective traveling pneumatic cleaner 11 during any one of the intervals between such successive time cycles, all the other valve means are maintained in the closed position so as to further reduce the amount of suction required to effectively transfer the fiber waste from each collection chamber into the respective unloading station.

In the drawings and specification there has been set forth a preferred embodiment of the invention and although specific terms are employed, they are used in a generic and descriptive sense only and not for purposes of limitation.

That which is claimed is:

1. In a fiber waste disposal system for a textile room containing fiber waste generating textile machines and having a traveling pneumatic cleaner with at least one fiber waste collection chamber thereon movable in a predetermined path adjacent the textile machines, and door means on the collection chamber movable from a normally closed position to an opened position, and fiber waste unloading station means adjacent the path of travel of the traveling pneumatic cleaner and connected to a source of suction for removing fiber waste from the collection chamber during a portion of its travel along said path, said unloading station means including normally closed valve means for controlling the flow of suction air into the unloading station means, the combination therewith of actuating means responsive to movement of the traveling pneumatic cleaner into proximity to said unloading station means for opening said valve means and said door means for transferring fiber waste from the collection chamber of the traveling pneumatic cleaner into said unloading station means, and means operably associated with said actuating means for rendering the same inoperative for predetermined intervals which include at least some occasions of movement of the traveling pneumatic cleaner into proximity to said unloading station means.

2. A fiber waste disposal system according to claim 1 wherein said actuating means comprises sensing means associated with said unloading station means for sensing the presence of the traveling cleaner when it is proximal to said unloading station means and for signaling such sensed presence, said sensing means normally being in an inactive condition during said predetermined intervals of inoperativeness of said actuating means, said means for rendering said actuating means inoperative also being operable during periods between successive ones of said predetermined intervals for maintaining said sensing means in an active condition, and means responsive to signaling by said sensing means upon sensing the presence of the traveling cleaner proximal to said unloading station means, while said sensing means is in said active condition, for opening said valve means of said unloading station means and opening said collection chamber door means of the traveling cleaner.

3. In a fiber waste disposal system for a textile room containing fiber waste generating textile machines and having a traveling pneumatic cleaner with at least one fiber waste collection chamber thereon movable in a predetermined path adjacent the textile machines, and door means on the collection chamber movable from a normally closed position to an opened position, and fiber waste unloading station means adjacent the path of travel of the traveling pneumatic cleaner and connected to a source of suction for removing fiber waste from the collection chamber during a portion of its travel along said path, said unloading station means including normally closed valve means for controlling the flow of suction air into the unloading station means, the combination therewith of control means for effecting opening of said valve means of said unloading station means and said door means of the traveling cleaner upon only certain occasions of movement of the traveling cleaner into proximity to said unloading station means and comprising carrier means adjacent said unloading station means and being transformable from a normally inactive condition to an active condition relative to the traveling cleaner for positioning elements of said control means for engagement with the traveling cleaner, timer means for resettably timing a normally operating time cycle of predetermined duration and being operably associated with said carrier means to prevent transformation of said carrier means to said active condition during each such time cycle and to be reset upon transformation of said carrier means to said inactive condition, actuating means responsive only to movement of the traveling cleaner into proximity to said unloading station means which occur at intervals between successively reset timed cycles of said timer means for opening said valve means and transforming said carrier means into said active condition, and said actuating means including means operably associated with said carrier means and effective upon transformation of said carrier means into said active condition for opening said door means on the collection chamber to transfer fiber waste therefrom into said unloading station means.

4. A fiber waste disposal system according to claim 3 wherein the traveling cleaner is adapted to travel alternatively in one direction and in the opposite direction along said predetermined path, and wherein said actuating means comprises first and second sensors positioned along opposite sides of said unloading station means for respectively opening and closing said valve means associated therewith during said intervals irrespective of the direction of the traveling pneumatic cleaner past said unloading station means.

5. A fiber waste disposal system according to claim 4 wherein said actuating means further comprises means responsive to each sensor sensing the traveling pneumatic cleaner proximal thereto following the transfer of fiber waste from the collection chamber into said unloading station means for returning said carrier means to said inactive condition and initiating a succeeding time cycle in the operation of said timer means.

6. In a fiber waste disposal system for a textile room containing fiber waste generating textile machines and having a traveling pneumatic cleaner with at least one fiber waste collection chamber thereon movable in a predetermined path adjacent the textile machines, and door means on the collection chamber movable from a normally closed position to an opened position, fiber waste unloading station means adjacent the path of travel of the traveling pneumatic cleaner and connected to a source of suction for removing fiber waste from the collection chamber during a portion of its travel along said path, and normally closed valve means operatively associated with said unloading station means for controlling the flow of suction air into the unloading station means, the combination therewith of control means for effecting opening of said valve means of said unloading station means and said door means of the traveling cleaner upon only certain occasions of movement of the traveling cleaner into proximity to said unloading station means and comprising carrier means adjacent the unloading station means and being movable from a normally inactive position to an active position relative to the path of the traveling cleaner for positioning elements of said control means for engagement with the traveling cleaner, timer means for resettably timing a normally operating time cycle of predetermined duration and being operably associated with said carrier means to prevent movement of said carrier means to said active position during each such time cycle and to be reset upon transformation of said carrier means to said inactive condition, actuating means responsive only to movement of the traveling cleaner into proximity to said unloading station means which occur at intervals between successively reset timed cycles of said timer means for opening said valve means and moving said carrier means into said active position, and said actuating means including means operably associated with said carrier means and effective upon movement of said carrier means into said active position for opening said door means on the collection chamber to transfer fiber waste therefrom into said unloading station means.

7. A fiber waste disposal system according to claim 6 wherein said actuating means comprises a sensor associated with said unloading station means for sensing the presence of the traveling cleaner when it is proximal to said unloading station means, means interconnecting said timer means and said sensor for rendering said sensor ineffective in responding to the presence of the proximal traveling cleaner during each time cycle of said timer means and so that the sensor only responds to the presence of the traveling cleaner during intervals between successive time cycles of said timer means, and means responsive to said sensor sensing the presence of the traveling cleaner during any of said intervals for opening said valve means and moving said carrier means into said active position.

8. A fiber waste disposal system according to claim 6 or 7 including means operably associated with said carrier means and effective upon movement thereof into said active position for interrupting travel of the traveling cleaner for a predetermined interval of time during the transfer of fiber waste from said collection chamber into said unloading station means.

9. A fiber waste disposal system according to claim 7 wherein said actuating means further includes an additional sensor spaced from the first-named sensor and arranged to sense the presence of the traveling cleaner subsequent to the transfer of fiber waste from its collection chamber into said unloading station means, and means responsive to the sensing of the traveling cleaner by said additional sensor for returning said carrier means to its respective inactive position and for initiating a succeeding time cycle of said timer means.

10. A fiber waste disposal system according to claim 6 wherein the traveling cleaner is adapted to travel at times in one direction and at other times in an opposite direction along said path and wherein said actuating means is responsive to movements of the traveling cleaner in both of said directions during respective intervals between successive time cycles of said timer means.

11. In a fiber waste disposal system for a textile room containing fiber waste generating textile machines and having a traveling pneumatic cleaner with at least two successive spaced apart fiber waste collection chambers thereon and being movable in a predetermined path adjacent the textile machines, and door means on each collection chamber movable from a normally closed position to an opened position, fiber waste unloading station means adjacent the path of travel of the traveling pneumatic cleaner and connected to a source of suction for removing fiber waste from the collection chambers during a portion of the travel of the cleaner along said path, and normally closed valve means operatively associated with the unloading station means for controlling the flow of suction air into the unloading station means, the combination therewith of control means for effecting opening of said valve means of said unloading station means and said door means of the traveling cleaner upon only certain occasions of movement of the traveling cleaner into proximity to said unloading station means and comprising carrier means adjacent the unloading station means and being movable from a normally inactive position to an active position relative to the path of the traveling cleaner for positioning elements of said control means for engagement with the traveling cleaner, timer means for resettably timing a normally operating time cycle of predetermined duration and being operably associated with said carrier means to prevent movement of said carrier means to said active position during each time cycle of said timer means and to be reset upon transformation of said carrier means to said inactive condition actuating means responsive only to movement of the traveling cleaner into proximity to the unloading station means which occur at intervals between successively reset timed cycles of said timer means for opening said valve means and moving said carrier means into said active position, and said actuating means including means operably associated with said carrier means and effective upon movement of said carrier means into said active position for successively opening the door means on said successive collection chambers for transferring fiber waste therefrom into said unloading station means.

12. A fiber waste disposal system according to claim 11 wherein said actuating means comprises a sensor associated with said unloading station means for sensing the presence of the traveling cleaner when it is proximal to said unloading station means, means interconnecting said timer means and said sensor for rendering said sensor ineffective in responding to the presence of the proximal traveling cleaner during each time cycle of said timer means and so that the sensor only responds to the presence of the traveling cleaner during intervals between successive time cycles of said timer means, and means responsive to said sensor sensing the presence of the traveling cleaner during any of said intervals for opening said valve means and moving said carrier means into said active position.

13. A fiber waste disposal system according to claim 10 or 11 including means operably associated with said carrier means and effective upon movement thereof into said active position for interrupting travel of the traveling cleaner for a predetermined interval of time during the transfer of fiber waste from each respective collection chamber into said unloading station means.

14. A fiber waste disposal system according to claim 12 wherein said control means also includes an additional sensor spaced from the first-named sensor and arranged to sense the presence of the traveling cleaner subsequent to the transfer of fiber waste from its collection chambers into said unloading station means, and means responsive to the sensing of the traveling cleaner by said additional sensor for returning said carrier means to its respective inactive position and for initiating a succeeding time cycle of said timer means.

15. In a fiber waste disposal system for a textile room containing fiber waste generating textile machines and having a plurality of traveling pneumatic cleaners each including at least one fiber waste collection chamber thereon, and wherein each traveling cleaner is movable in a respective predetermined path adjacent a respective series of the textile machines, and door means on each collection chamber movable from a normally closed position to an opened position, fiber waste unloading station means adjacent the path of travel of each traveling cleaner, with all the unloading station means connected to a common source of suction for removing fiber waste from the collection chambers during a portion of the travel of each respective traveling cleaner along its respective path, and valve means operatively associated with each of said unloading station means and being movable from a normally closed position to an opened position for permitting the flow of suction air into each respective unloading station means and to the common source of suction, the combination therewith of actuating means responsive to movement of each traveling pneumatic cleaner into proximity to its respective unloading station means for opening the respective valve means and said door means of the respective traveling cleaner for transferring fiber waste from the respective collection chamber into the respective unloading station means, timer means operably associated with each actuating means for resettably timing a normally operating time cycle of a predetermined duration in response to operation of said actuating means, and means interconnecting each timer means and the respective actuating means for normally preventing operation of the respective valve means and door means in response to movement of the respective traveling cleaner into proximity to its respective unloading station means during a timed cycle of the respective timer means, each timer means serving to permit operation of the valve means and door means by the respective actuating means during intervals between successive time cycles of each timer means.

16. A fiber waste disposal system according to claim 15 further comprising means interconnecting a plurality of timer means associated with a corresponding plurality of said actuating means, and means operable upon any one of said plurality of actuating means effecting the opening of the respective valve means for also preventing operation of any other of the valve means by any other of said plurality of actuating means during any intervals of time transpiring between successive time cycles of a respective other of the timer means.

17. In a fiber waste disposal system for a textile room containing a plurality of groups of fiber waste generating textile machines and having a plurality of traveling pneumatic cleaners each movable in a predetermined path adjacent a respective group of textile machines, each traveling cleaner having at least one collection chamber thereon for collecting fiber waste therein, and door means on each collection chamber and being movable from a normally closed position to an opened position, fiber waste unloading station means adjacent the path of travel of each respective traveling cleaner for removing fiber waste from the collection chamber of the respective traveling cleaner during a portion of its travel along said path, means connecting all the unloading station means to a common source of suction, and normally closed valve means operatively associated with each unloading station means for controlling the flow of suction air into each respective unloading station means, the combination therewith of a plurality of individual control means each operably associated with a respective unloading station means for effecting opening of the respective valve means and said door means of the respective traveling cleaner upon only certain occasions of movement of the traveling cleaner into proximity to the respective unloading station means, each control means comprising carrier means adjacent the respective unloading station means and being movable from a normally inactive position to an active position relative to the path of travel of the respective traveling cleaner for positioning elements of the respective control means for engagement with the respective traveling cleaner, timer means for resettably timing a normally operating time cycle of predetermined duration and being operably associated with said carrier means to prevent movement thereof to said active position during each time cycle of said timer means and to be reset upon movement thereof to said inactive position, actuating means responsive only to those movements of each traveling cleaner into proximity to the respective unloading station means which occur at intervals between successive operating time cycles of the respective timer means for opening the respective valve means and moving the respective carrier means into said active position, and said actuating means including means operably associated with each carrier means and effective upon movement of the respective carrier means into said active position for opening said door means on said collection chamber of the respective traveling cleaner to transfer fiber waste therefrom into the respective unloading station means, and means interconnecting the timer means of all said control means and including means responsive to movement of any one of said carrier means out of its inactive position for preventing said actuating means of any of the other control means from opening the respective valve means and from moving the respective carrier means into said active position during any intervals between successive operating time cycles of the respective timer means.

18. A fiber waste disposal system according to claim 17 wherein each traveling cleaner is adapted to travel alternatively in one direction and in the opposite direction along its respective predetermined path, and wherein said actuating means comprises first and second sensors positioned along opposite sides of each unloading station means for respectively opening and closing the respective valve means associated therewith during said intervals irrespective of the direction of each traveling pneumatic cleaner past its respective unloading station means.

19. A method of handling fiber waste created by a group of textile machines comprising the steps of directing a traveling pneumatic cleaner along a predetermined path of travel associated with the group of textile machines while collecting fiber waste generated by the textile machines in a waste collection chamber on the traveling cleaner, repeatedly moving the traveling cleaner past an unloading station during its travel, and only during certain movements of the traveling cleaner past the unloading station effecting transfer of the collected fiber waste from the collection chamber of the traveling cleaner into the unloading station by suction.

20. A method of handling fiber waste created by textile machines comprising the steps of directing a plurality of traveling pneumatic cleaners along respective predetermined paths of travel associated with respective groups of the textile machines while collecting fiber waste generated by each group of the textile machines in a fiber waste collection chamber on the respective traveling cleaner, providing a respective unloading station adjacent the path of travel of each traveling cleaner with all the unloading stations connected to a common source of suction, repeatedly moving each traveling cleaner past its respective unloading station, and during only certain movements of each traveling cleaner past its respective unloading station effecting transfer of collected fiber waste from the collection chamber of the respective traveling cleaner into the respective unloading station by the suction air flow being induced by the common source of suction, while concurrently preventing the transfer of fiber waste from the collection chambers of the respective other traveling cleaners into said any other of the unloading stations.

* * * * *